US012669051B1

(12) United States Patent
Matthews et al.

(10) Patent No.: US 12,669,051 B1
(45) Date of Patent: Jun. 30, 2026

(54) IDENTIFYING LANDING OF DOWNHOLE EQUIPMENT AT A WELLHEAD

(71) Applicant: Schlumberger Technology Corporation, Sugar Land, TX (US)

(72) Inventors: James Matthews, Houston, TX (US); Yong Wee Lee, Singapore (SG); Haw Keat Lim, Singapore (SG); Navya Yenuganti, Sugar Land, TX (US); Rachna Sharma, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/047,884

(22) Filed: Feb. 7, 2025

(51) Int. Cl.
*E21B 47/095* (2012.01)
*E21B 47/14* (2006.01)

(52) U.S. Cl.
CPC ..... *E21B 47/095* (2020.05); *E21B 47/14* (2013.01)

(58) Field of Classification Search
CPC ..... E21B 47/095; E21B 47/14
See application file for complete search history.

(56) References Cited

U.S. PATENT DOCUMENTS

| | | | | |
|---|---|---|---|---|
| 5,678,643 | A * | 10/1997 | Robbins | E21B 7/04 175/45 |
| 7,219,762 | B2 | 5/2007 | James | |
| 9,107,010 | B2 | 8/2015 | Abdollahzadeh Milani | |
| 9,348,024 | B2 * | 5/2016 | Saito | G01S 7/53 |
| 9,606,250 | B2 | 3/2017 | Hull | |
| 10,612,366 | B2 * | 4/2020 | Gilleland | E21B 47/092 |
| 11,414,987 | B2 * | 8/2022 | Fellinghaug | E21B 41/0085 |
| 11,554,387 | B2 * | 1/2023 | Jin | E21B 47/14 |
| 11,808,141 | B2 | 11/2023 | Lim | |
| 11,902,745 | B2 * | 2/2024 | Mendez Rodriguez | H04R 25/55 |
| 2024/0232623 | A1 * | 7/2024 | Loviken | G01S 15/08 |

FOREIGN PATENT DOCUMENTS

| | | | | |
|---|---|---|---|---|
| CN | 118150706 | A | 6/2024 | |
| CN | 118262730 | A * | 6/2024 | G10L 19/02 |
| EP | 3551835 | B1 | 12/2022 | |
| EP | 4141217 | A1 | 3/2023 | |
| EP | 4334759 | A1 | 3/2024 | |
| WO | 2020139944 | A1 | 7/2020 | |

* cited by examiner

*Primary Examiner* — Franklin D Balseca
(74) *Attorney, Agent, or Firm* — Kyle R. Miiller

(57) ABSTRACT

A wellhead landing, locking and sealing detection system may receive an acoustic signal from at least one acoustic sensor located on an outer surface of a wellhead. A wellhead landing, locking and sealing detection system may process the acoustic signal resulting in a processed acoustic signal. Processing the acoustic signal may include normalizing the acoustic signal, smoothing the acoustic signal, and differentiating a background signal from the acoustic signal. A wellhead landing, locking and sealing detection system may select a portion of the processed acoustic signal. A wellhead landing, locking and sealing detection system may identify a reflection characterization, frequency or profile from the portion. A wellhead landing, locking and sealing detection system may, based on the reflection characterization, frequency or profile, identifying a landing, locking and sealing configuration of the equipment with the wellhead.

18 Claims, 7 Drawing Sheets

IDENTIFYING LANDING OF DOWNHOLE EQUIPMENT AT A WELLHEAD

BACKGROUND OF THE DISCLOSURE

Wellheads provide access to a wellbore while maintaining fluid pressure and/or fluid flow, or isolating the wellbore from the surface environment. In some situations, downhole equipment, casings, tubing, instrumentation, and other elements may be inserted into the wellbore via the wellhead. The wellhead may temporarily or permanently suspend the downhole equipment.

SUMMARY

In some aspects, the techniques described herein relate to a method for detecting when a wellhead internal component or equipment has landed, locked, or sealed at a wellhead. A wellhead landing detection system receives an acoustic signal from at least one acoustic sensor located on an outer surface of a wellhead. The wellhead landing detection system processes the acoustic signal, resulting in a processed acoustic signal. Processing the acoustic signal includes: normalizing the acoustic signal; smoothing the acoustic signal; and differentiating a background signal from the acoustic signal. The wellhead landing detection system selects a portion of the processed acoustic signal. A reflection characterization is identified from the portion. Based on the reflection characterization, frequency, and profile of signal, the wellhead landing detection system identifies a landing, locking, and sealing configuration of the wellhead internal component equipment with the wellhead.

In some aspects, the techniques described herein relate to a wellhead landing detection system. The wellhead landing detection system incudes an acoustic sensor configured to be secured to an outer surface of a wellhead opposite a landing location at an inner surface of the wellhead. And a processor and memory, the memory includes instructions that cause the processor to emit an acoustic pulse from the acoustic sensor. The memory further causes the processor to receive a reflection of the acoustic pulse as an acoustic signal. The memory further causes the processor to process the acoustic signal resulting in a processed acoustic signal. Processing the acoustic signal includes normalizing the acoustic signal, smoothing the acoustic signal, and differentiating a background signal from the acoustic signal. The memory further causes the processor to select a portion of the processed acoustic signal. The memory further causes the processor to identify a reflection characterization from the portion. The memory further causes the processor to, based on the reflection characterization, identify a landing, locking, and sealing configuration of wellhead internal component equipment with the wellhead.

In some aspects, the techniques described herein relate to a method for identifying a landing, locking, and sealing configuration. A wellhead landing detection system emits an acoustic pulse from the acoustic sensor. The wellhead landing detection system receives a reflection of the acoustic pulse as an acoustic signal. The wellhead landing detection system normalizes the acoustic signal. The wellhead landing detection system smooths the acoustic signal. The wellhead landing detection system differentiates a background signal from the acoustic signal. The wellhead landing detection system selects a portion of the acoustic signal. The wellhead landing detection system identifies a reflection characterization from the portion. The wellhead landing detection system 100, based on the reflection characterization, identifies a landing configuration of equipment with the wellhead.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
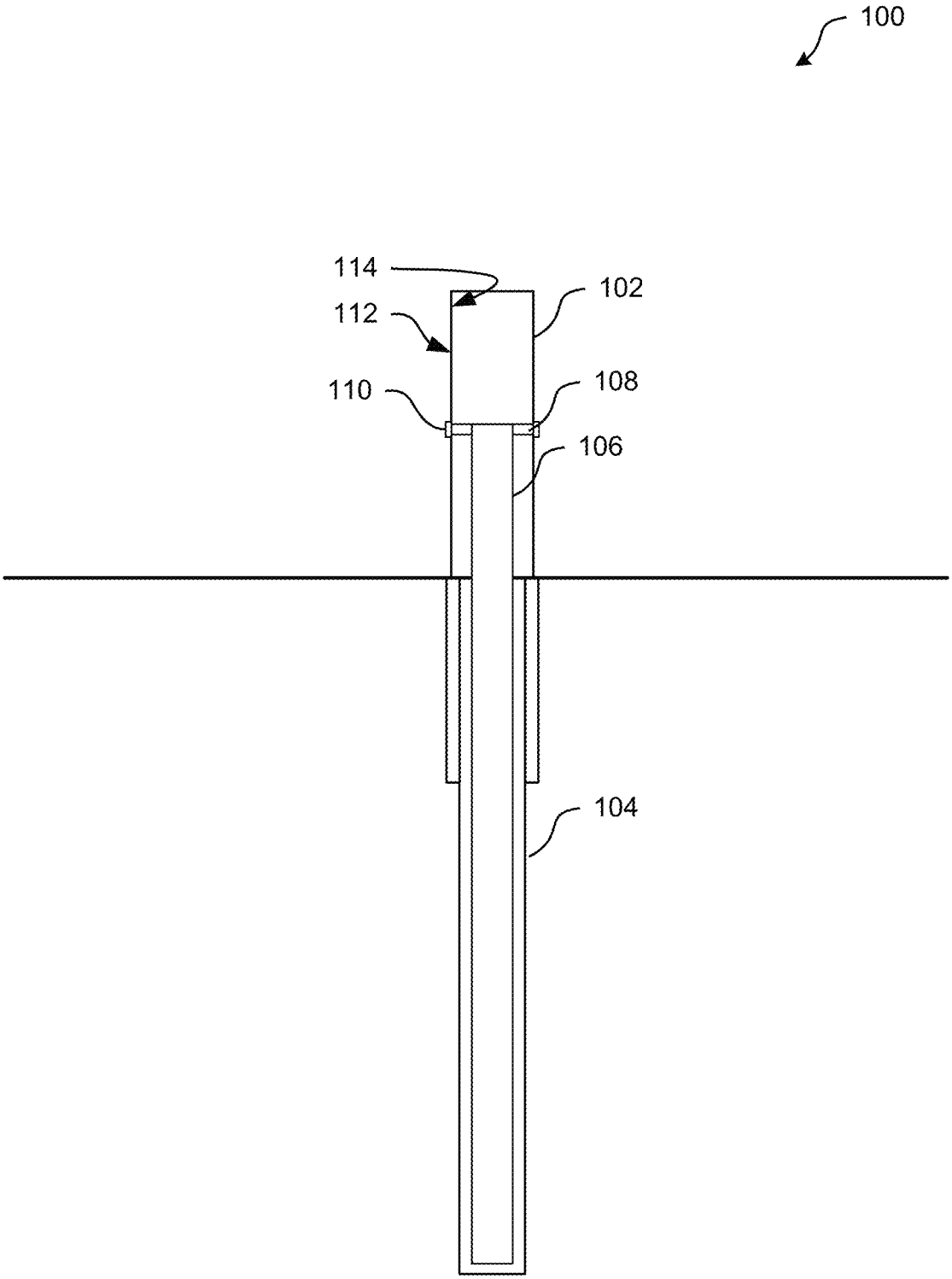
FIG. 1 is a schematic diagram of a wellhead landing, locking, and sealing detection system, according to at least one embodiment of the present disclosure.

This disclosure generally relates to devices, systems, and methods for identifying the landing of wellhead internal equipment at a wellhead. A wellhead may support various wellhead internal equipment, such as casing hanger, tubing hanger and packoff, and so forth. The equipment may be suspended from the wellhead. For example, the wellhead internal equipment may connect to the wellhead through a hanger, a socket, a shoulder, a threaded connection, a lock ring, and other connections. The connection between the wellhead and the internal component equipment may be internal to the wellhead. Because this connection is internal to the wellhead, visual sensors external to the wellhead may not be able to capture when the connection has been made. Further, sensors internal to the wellhead may be subject to the harsh environment inside the wellhead, which may include high temperatures, high pressures, harsh chemicals, acidic conditions, and so forth.

In accordance with at least one embodiment of the present disclosure, a wellhead landing, locking, and sealing detection system may include one or more acoustic sensors located on an outer surface of the wellhead. While embodiments of the present disclosure may discuss the acoustic sensors as being located on the outer surface of the wellhead, it should be understood that the techniques of the present disclosure may be applied to other surface equipment near the wellhead. For example, the acoustic sensors may be located on the wellhead, on surface equipment near the wellhead, around the wellhead, in direct contact with the wellhead, or on surface equipment in contact with the wellhead, such as a drilling adapter or other equipment in contact with the wellhead. The acoustic sensor may periodically or continuously emit an ultrasonic pulse. The acoustic sensor may include a receiver that may receive an acoustic signal that includes the ultrasonic waves reflected from the wellhead and/or the internal equipment. The wellhead landing, locking and sealing detection system may use the acoustic signal to identify whether the internal component equipment has landed, locked, or sealed at the wellhead. Locating the sensors on the outer surface of the wellhead, may facilitate improved accessibility and reliability of the wellhead landing detection system.

To detect whether the equipment has landed at the wellhead, the wellhead landing detection system may process the acoustic signal. Processing the acoustic signal may improve the identification of whether the equipment has landed at the landing shoulder, locking at the groove, or sealing at sealing surface (e.g., the landing configuration). For example, processing the acoustic signal may reduce noise, smooth the signal, or otherwise improve identification of landing. As discussed in further detail herein, processing the acoustic signal may include one or more of normalizing the acoustic signal, smoothing the acoustic signal, and differentiating background noise from the acoustic signal.

In some embodiments, the wellhead landing detection system may isolate a portion of the acoustic signal to identify whether the downhole equipment is in the landing configuration. For example, the wellhead landing detection system may select a portion of the acoustic signal to analyze for the landing configuration. For example, the wellhead landing detection system may identify a landing portion of the acoustic signal that may be associated with identifying the landing event. The wellhead landing detection system may identify the landing portion based on the speed of sound of the wellhead and the thickness of the wellhead. The wellhead landing detection system may isolate the portions of the acoustic signal prior to when the signal may bounce from the inner wall of the wellhead back to the outer wall. This may help to reduce the amount of information processed by the wellhead landing detection system, thereby reducing the total amount of processing of the wellhead landing detection system.

FIG. 1 is a schematic diagram of a wellhead landing detection system 100, according to at least one embodiment of the present disclosure. The wellhead landing detection system 100 includes a wellhead 102 located at the surface of a wellbore 104. The wellhead 102 may support equipment 106. The equipment 106 may include any equipment that may be supported by the wellhead 102, such casing hanger, tubing hanger, and packoff and so forth. The wellhead 102 may be any type of wellhead, including a production wellhead, an exploration wellhead, an intervention wellhead, or other wellhead.

The equipment 106 may be suspended by the wellhead 102 with a hanger 108. The hanger 108 may at least partially support equipment 106. In some embodiments, the hanger 108 may permanently support the equipment 106. In some embodiments, the hanger 108 may temporarily support the equipment 106 until a new piece of equipment is installed. For example, the hanger 108 may temporarily support a length of casing until a new length of casing can be connected. As used herein, the downhole equipment 106 may be considered to be "landed" or in a "landing configuration" when the downhole equipment 106 is seated at the hanger 108. For example, the downhole equipment 106 may be considered to be landed or in a landing configuration when the downhole equipment 106 is in contact with the wellhead 102 and the hanger 108. Such a landing configuration may include a locking of the downhole equipment 106 with the wellhead 102 (e.g., a locking configuration), a sealing of the downhole equipment 106 with the wellhead 102 (e.g., a sealing configuration), or a combination of two or three of landing, locking, or sealing of the downhole equipment 106 with the wellhead 102. While embodiments of the present disclosure may refer to detecting a "landing configuration," it should be understood that such detections may include one or more of landing, locking, or sealing.

In accordance with at least one embodiment of the present disclosure, the wellhead landing detection system 100 may include one or more acoustic sensors 110. The acoustic sensors 110 may be used to determine whether the downhole equipment 106 has landed at the wellhead 102. For example, the acoustic sensors 110 may be acoustically connected or in acoustic communication with the wellhead 102. The acoustic signal received by the acoustic sensors 110 may be different based on whether the downhole equipment 106 has landed at the wellhead 102. In this manner, the acoustic sensors 110 may be used to monitor the wellhead 102 to determine whether the downhole equipment 106 is properly landed or properly connected to the wellhead 102.

In accordance with at least one embodiment of the present disclosure, the acoustic sensors 110 may be located on an outer surface 112 of the wellhead 102. When the equipment 106 is landed, the equipment 106 may be in contact with an inner surface 114 of the wellhead 102. For example, the equipment 106 may be in direct contact with the inner surface 114 of the wellhead 102, or the downhole equipment 106 may be in contact with the hanger 108 which may be in contact with the inner surface 114 of the wellhead 102.

To identify whether the equipment 106 has landed at the wellhead 102, the acoustic sensors 110 may receive an acoustic signal that has traveled or transferred through the wellhead 102. For example, the acoustic sensors 110 may be in acoustic communication with the wellhead 102. In some examples, the acoustic sensors 110 may be in direct contact with the outer surface 112 of the wellhead 102. Acoustic signals transmitted through the wellhead 102 may be received by the acoustic sensors 110. An acoustic signal may be a vibration or wave that is propagated through the material of the wellhead 102.

In some embodiments, the acoustic sensors 110 may include an acoustic signal transmitter. For example, the acoustic sensors 110 may generate an acoustic pulse, which may include an acoustic wave in a pre-determined pattern. For example, the acoustic sensors 110 may generate an acoustic pulse having an acoustic frequency. In some embodiments, the acoustic frequency may be in a range having an upper value, a lower value, or upper and lower values including any of 5 kHz, 10 kHz, 15 kHz, 20 kHz, 25 kHz, 30 kHz, 35 kHz, 40 kHz, 45 kHz, 50 kHz, 100 kHz, 200 kHz, 300 kHz, 400 kHz, 500 kHz, 600 kHz, 700 kHz, 800 kHz, 900 kHz, 1,000 kHz, or any value therebetween.

For example, the acoustic frequency may be greater than 5 kHz. In another example, the acoustic frequency may be less than 1,000 kHz. In yet other examples, the acoustic frequency may be any value in a range between 5 kHz and 1,000 kHz. In some embodiments, it may be critical that the acoustic frequency is greater than 20 kHz to provide an acoustic signal that may facilitate identification of the landing condition. In some embodiments, the acoustic frequency may be ultrasonic, or may be at a frequency that is undetectable by humans, either through tough or through transmission of the ultrasonic pulse from the wellhead 102 to the surrounding air.

When the acoustic sensors 110 issue the acoustic pulse, the acoustic wave may propagate through the material and the body of the wellhead 102. At least a portion of the acoustic wave may be reflected. For example, the internal structure of the wellhead 102 may cause at least a portion of the acoustic wave to deflect, reflect, disperse, or otherwise change path or direction (collectively referred to herein as "reflected"). At least some of the reflected acoustic wave may be received at the acoustic sensors 110 as an acoustic signal.

In some embodiments, the acoustic signal may be different based on whether the downhole equipment 106 is landed at the wellhead 102, or is landed in a desired position or configuration. For example, when the acoustic wave reaches the inner surface 114, the acoustic wave may be propagated through the inner surface 114 to the downhole equipment 106. This may change the profile of the acoustic signal. For example, the waveform, the frequency, the amplitude, the specific spikes, or other elements of the acoustic signal may be changed by the propagation through and reflection of the acoustic wave in the downhole equipment 106. The acoustic sensors 110 may measure the incoming acoustic wave as received at the outer surface 112.

The wellhead landing detection system 100 may receive the acoustic signal from the acoustic sensors 110. The wellhead landing detection system 100 may analyze the acoustic signal to identify a signature in the acoustic signal that is associated with the downhole equipment 106 in the landing configuration. In accordance with at least one embodiment of the present disclosure, processing the acoustic signal may include statistically processing the acoustic signal. In some embodiments, the wellhead landing detection system 100 may perform one or more processing acts to identify whether the downhole equipment 106 is in the landing configuration. The processing acts may include one or more statistical acts or statistical operation to improve signal clarity. Processing the acoustic signal may be performed to improve the interpretation of the acoustic signal.

As discussed in further detail herein, processing the acoustic signal may include one or more of normalizing the acoustic signal, smoothing the acoustic signal, or differentiating background noise from the acoustic signal. Normalizing the acoustic signal may improve the analysis of the signal by adjusting the amplitude so that the acoustic signal has an average, maximum, or minimum amplitude that is consistent. This may help to remove or reduce inconsistencies in the acoustic signal.

Smoothing the acoustic signal may include reducing the noise of the acoustic signal by adjusting the values of a datapoint based on adjacent or nearby datapoints. For example, smoothing the acoustic signal may include reducing or increasing the value of a datapoint based on the average or trends of nearby datapoints. Smoothing the acoustic signal may help to reduce noise in the acoustic signal while retaining trends or patterns in the acoustic signal.

In some embodiments, differentiating background noise from the acoustic signal may include subtracting or moving values of the background noise from the acoustic signal. For example, the internal structure, connections, and other elements of the wellhead 102 may cause reflections in the acoustic wave. These reflections may be received by the acoustic sensors 110 with the acoustic signal and identified as background noise. Subtracting the background noise from the acoustic signal may reduce the noise of the acoustic signal and facilitate improved identification of the landing configuration.

In accordance with at least one embodiment of the present disclosure, the wellhead landing detection system 100 may isolate a portion of the acoustic signal. For example, the wellhead landing detection system 100 may isolate the portion of the acoustic signal that may include a reflection from the contact between the wellhead 102 and the downhole equipment 106. This may reduce the processing of the acoustic signal, thereby increasing the speed at which the landing configuration is identified.

In accordance with at least one embodiment of the present disclosure, the wellhead landing detection system 100 may identify a reflection characterization of the landing configuration. The reflection characterization may be an amplitude, frequency, peak, pattern, profile, sequence, or other portion of a wavelength of the received acoustic signal. The reflection characterization may be used to identify the landing configuration. For example, the received reflection characterization from the acoustic signal may be compared to a predetermined reflection characterization that is associated with the landing configuration. When the received reflection characterization matches the predetermined reflection characterization, the wellhead landing detection system 100 may determine that the downhole equipment 106 has landed at the wellhead 102.

In this manner, the wellhead landing detection system 100 may identify, using sensors located external to the wellhead 102, or not inside the interior of the wellhead 102, when the equipment 106 has landed at the wellhead 102. Identifying the landing configuration, using the acoustic sensors 110, may reduce the time to install the equipment 106 at the wellhead 102 and/or ensure proper installation of the equipment 106.

Figure 2:
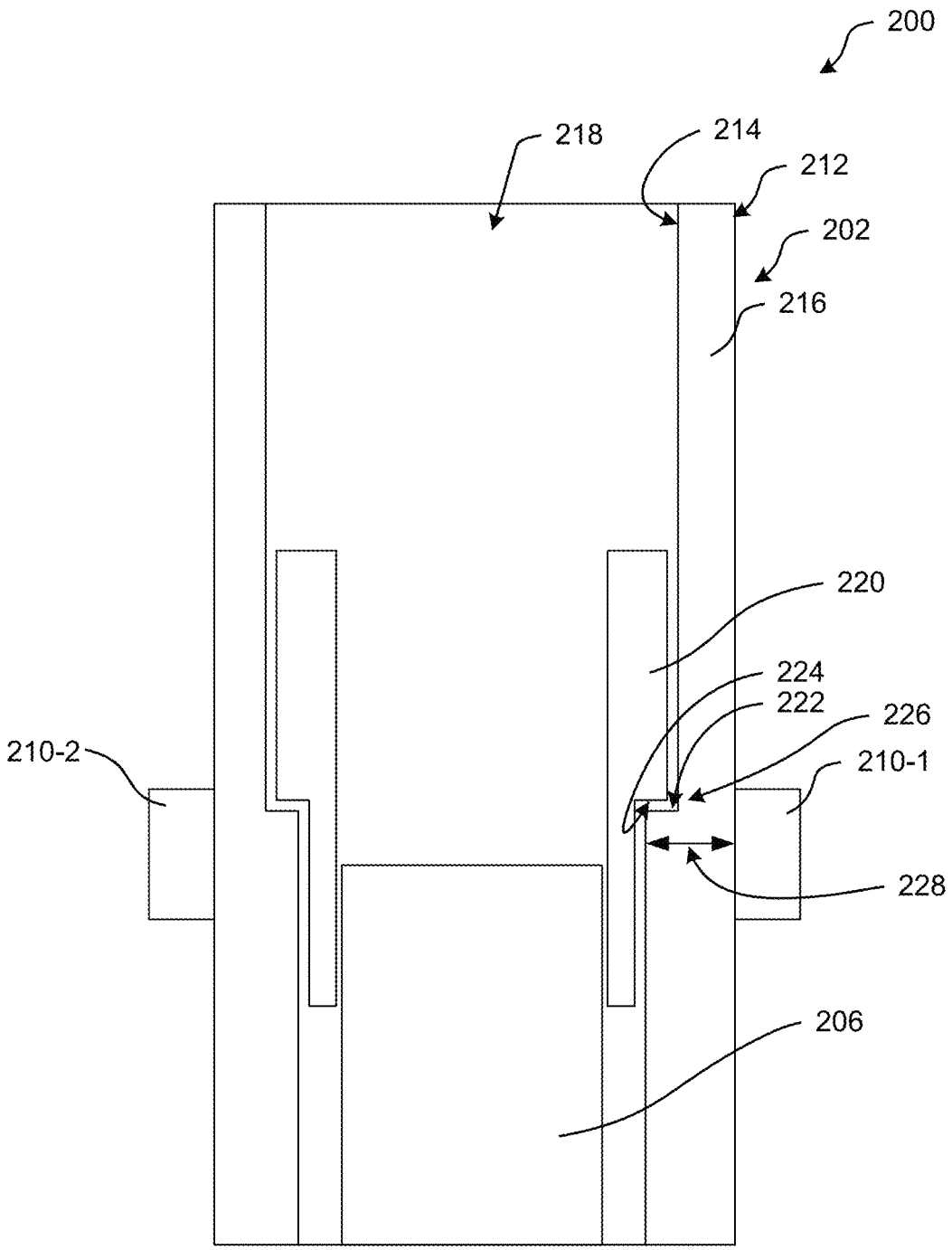
FIG. 2 is a schematic cross-sectional view of a wellhead landing, locking, and sealing detection system, according to at least one embodiment of the present disclosure.

FIG. 2 is a schematic cross-sectional view of a wellhead landing detection system 200, according to at least one embodiment of the present disclosure. The wellhead landing detection system 200 includes a wellhead 202. The wellhead 202 includes a wall 216 having an outer surface 212 and an inner surface 214. The wellhead 202 further defines a bore 218 extending therethrough, the bore 218 being an interior space or inner space of the wellhead 202.

During installation of downhole equipment 206, the downhole equipment 206 may be at least temporarily suspended from the wellhead 202. For example, in the embodiment shown, the downhole equipment 206 includes casing, and the casing is suspended from the wellhead 202. For example, the casing may be suspended from the 202 while a new casing segment is being installed.

The downhole equipment 206 may be suspended from a hanger 220. The downhole equipment 206 may be connected or secured to the hanger 220 in any manner. For example, the downhole equipment 206 may be connected to the hanger 220 with a threaded connection, a press-fit connection, or other connection. The wall 216 may include a wellhead shoulder 222, which may be a ledge or other protrusion of the wall 216 into the bore 218 of the wellhead 202. The hanger 220 may include a complementary hanger shoulder 224. The wellhead shoulder 222 and the hanger shoulder 224 may engage or contact at a landing location 226. The downhole equipment 206 may be suspended in the wellhead 202 when the hanger shoulder 224 is resting on the wellhead shoulder 222. Put another way, the downhole equipment 206 may be landed at the wellhead 202, or in the landed condition, when the hanger shoulder 224 is in contact with the wellhead shoulder 222.

As may be seen, the downhole equipment 206 and the hanger 220 are located inside the bore 218. This may result in difficulties in detecting or determining when the downhole equipment 206 is in the landing configuration.

In accordance with at least one embodiment of the present disclosure, the wellhead landing detection system 200 includes one or more acoustic sensors (collectively 210). The acoustic sensors 210 may be located on the outer surface 212 of the wellhead 202. In some embodiments, the acoustic sensors 210 may be located on opposite the hanger 220. In some embodiments, the acoustic sensors 210 may be located opposite the hanger 220 at the landing location 226. Put another way, the acoustic sensors 210 may be located on the outer surface 212 of the wall 216 opposite the landing location 226 such that the acoustic sensors 210 are adjacent to the landing location 226 on the other side of the wall 216. This may improve the quality of the acoustic signal received at the acoustic sensors 210.

To determine whether the downhole equipment 206 is in the landing configuration, the acoustic sensors 210 may measure an acoustic signal that has been transmitted or propagated through the body of the wall 216. As discussed in further detail herein, the wellhead landing detection system 200 may process the acoustic signal to identify whether the downhole equipment 206 is in the landing configuration. The acoustic signal received by the acoustic sensors 210 may be different when the wellhead shoulder 222 and the hanger shoulder 224 are in contact. For example, the acoustic signal may change based on the distance traveled by the acoustic wave (e.g., the wall thickness 228 of the wall 216 and the thickness of the hanger 220). In some examples, the acoustic signal may change based on the difference in material between the hanger 220 and the wellhead 202.

In accordance with at least one embodiment of the present disclosure, the acoustic sensors 210 may include a first acoustic sensor 210-1 and a second acoustic sensor 210-2. The first acoustic sensor 210-1 and the second acoustic sensor 210-2 may be located at different locations around the outer surface 212 of the wellhead 202. For example, the second acoustic sensor 210-2 may be located 180° opposite the first acoustic sensor 210-1 around the outer surface 212 of the wellhead 202. However, it should be understood that the first acoustic sensor 210-1 and the second acoustic sensor 210-2 may be located at any position relative to each other. For example, the first acoustic sensor 210-1 and the second acoustic sensor 210-2 may have an angular spacing that includes 30°, 45°, 60°, 90°, 120°, 180°, or any value therebetween.

In accordance with at least one embodiment of the present disclosure, the wellhead landing detection system 200 may identify the landing configuration based on the acoustic signals received from multiple acoustic sensors. For example, the downhole equipment 206 may be in contact with the wellhead 202 at a first end, but not in contact at a second end. In some embodiments, the wellhead landing detection system 200 may verify that the downhole equipment 206 has properly seated or landed in the wellhead 202 when the acoustic signal from two or more acoustic sensors 210 indicates the landing configuration. In some embodiments, the wellhead landing detection system 200 may verify that the downhole equipment 206 has properly seated or landed in the wellhead 202 when all of the acoustic signals from all of the acoustic sensors 210 indicate the landing configuration.

In the embodiment shown, the wellhead landing detection system 200 includes two acoustic sensors 210. However, it should be understood that the wellhead landing detection system 200 may include any number of acoustic sensors 210, including 1, 2, 3, 4, 5, 6, 7, 8, 9, 10, 11, 12, or more acoustic sensors 210. In some embodiments, the acoustic sensors 210 may be evenly spaced around the outer surface 212 of the wellhead 202. In some embodiments, the acoustic sensors 210 may be unevenly spaced around the outer surface 212 of the wellhead 202. For example, the acoustic sensors 210 may be located adjacent a particular component of the hanger 220 or other structure elements of the wellhead landing detection system 200.

Figure 3:
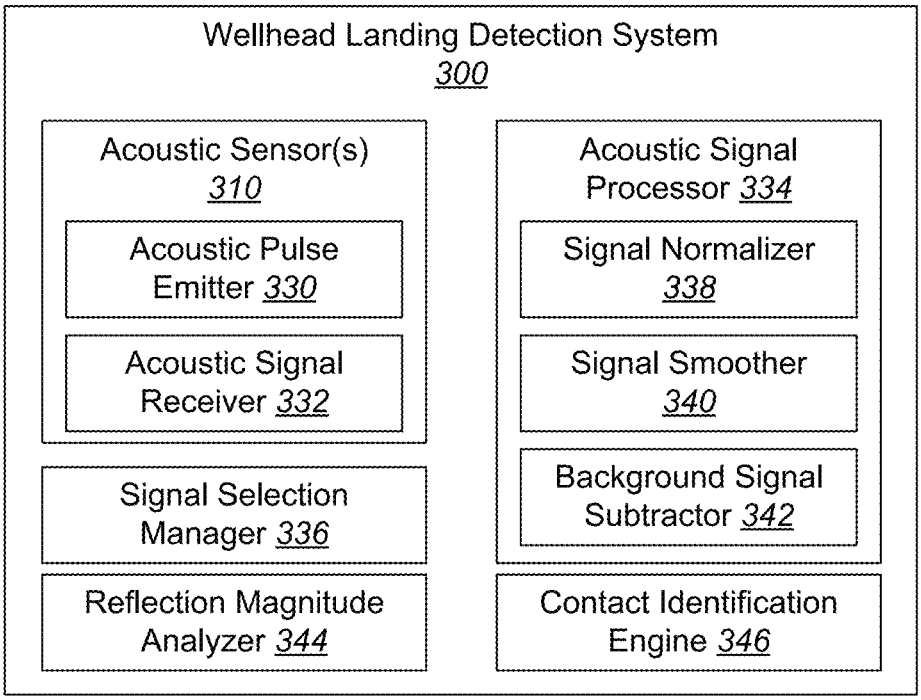
FIG. 3 is a schematic of a wellhead landing detection system, according to at least one embodiment of the present disclosure.

FIG. 3 is a schematic of a wellhead landing detection system 300, according to at least one embodiment of the present disclosure. Each of the components of the wellhead landing detection system 300 can include software, hardware, or both. For example, the components can include one or more instructions stored on a computer-readable storage medium and executable by processors of one or more computing devices, such as a client device or server device. When executed by the one or more processors, the computer-executable instructions of the wellhead landing detection system 300 can cause the computing device(s) to perform the methods described herein. Alternatively, the components can include hardware, such as a special-purpose processing device to perform a certain function or group of functions. Alternatively, the components of the wellhead landing detection system 300 can include a combination of computer-executable instructions and hardware.

Furthermore, the components of the wellhead landing detection system 300 may, for example, be implemented as one or more operating systems, as one or more stand-alone applications, as one or more modules of an application, as one or more plug-ins, as one or more library functions or functions that may be called by other applications, and/or as a cloud-computing model. Thus, the components may be implemented as a stand-alone application, such as a desktop or mobile application. Furthermore, the components may be implemented as one or more web-based applications hosted on a remote server. The components may also be implemented in a suite of mobile device applications or "apps."

The wellhead landing detection system 300 may include one or more acoustic sensors 310. The acoustic sensors 310 may include an acoustic pulse emitter 330 and an acoustic signal receiver 332. The acoustic pulse emitter 330 may apply an acoustic pulse having waveform (e.g., an acoustic wave) into the outer surface of the body of the wellhead. The acoustic signal receiver 332 may receive the acoustic wave as it is transmitted through and reflected by the body and other structures of the wellhead.

In some embodiments, the acoustic pulse emitter 330 may continuously emit an acoustic wave into the wellhead. In some embodiments, the acoustic pulse emitter 330 may periodically emit acoustic pulses into the wellhead. For example, the acoustic pulse emitter 330 may periodically emit acoustic pulses every 0.1 s, 0.5 s, 1.0 s, 1.5 s, 2.0 s, 2.5 s, 3.0 s, 3.5 s, 4.0 s, 4.5 s, 5.0 s, or any value therebetween.

Periodically emitting acoustic pulses may reduce the size of the acoustic signal received by the acoustic signal receiver 332.

The one or more acoustic sensors 310 may send the received acoustic signal to an acoustic signal processor 334. Put another way, the acoustic signal processor 334 may receive the acoustic signal to process the acoustic signal. The acoustic signal processor 334 may process the acoustic signal, outputting or resulting in a processed acoustic signal. The processed acoustic signal may be used to identify whether the downhole equipment is in the landing configuration.

The wellhead landing detection system 300 further includes a signal selection manager 336. The signal selection manager 336 may select or isolate the portion of the acoustic signal that is likely to be usable to identify the landing configuration. For example, the signal selection manager 336 may utilize the thickness of the wall of the wellhead (e.g., the wall thickness 228 illustrated in FIG. 2) to determine which portion of the acoustic signal may include reflection information that can identify the landing configuration. In some embodiments, the signal selection manager 336 may utilize the material composition of the wellhead to determine which portion of the acoustic signal may include the reflection information used to identify the landing configuration. For example, using the wall thickness and the speed of sound in the wall of the wellhead based on the material composition, the signal selection manager 336 may identify the amount of time the acoustic wave will take to travel from the acoustic pulse emitter 330 to the inner surface of the wall, and back to the acoustic signal receiver 332. In this manner, the signal selection manager 336 may remove reflections, noise, or other acoustic waves emitted from other acoustic sensors 310, thereby reducing the amount of information to be analyzed when identifying the landing configuration.

In some embodiments, the signal selection manager 336 may isolate or select the portion of the acoustic signal prior to the acoustic signal processor 334 processing the acoustic signal. In some embodiments, the signal selection manager 336 may isolate or select the portion of the acoustic signal from the processed acoustic signal generated by the acoustic signal processor 334.

As discussed herein, the acoustic signal processor 334 may process the acoustic signal by one or more of normalizing, smoothing, and subtracting background noise. For example, the acoustic signal processor 334 may include a signal normalizer 338. The signal normalizer 338 may apply a normalization algorithm to the acoustic signal (or the portion of the acoustic signal isolated or selected by the signal selection manager 336). The normalization algorithm may reduce the variability in the acoustic signal. The signal normalizer 338 may normalize the acoustic signal in any manner. For example, the signal normalizer 338 may apply min-max scaling, z-score normalization, Fourier transforms, any other normalization algorithm, and combinations thereof. In some examples, the signal normalizer 338 may normalize the acoustic signal by subtracting a maximum value of the acoustic signal from other portions of the acoustic signal.

The acoustic signal processor 334 may further include a signal smoother 340. The signal smoother 340 may smooth the acoustic signal to improve the interpretation of the acoustic signal. The signal smoother 340 may apply a smoothing algorithm to the acoustic signal (or the portion of the acoustic signal isolated or selected by the signal selection manager 336). The smoothing algorithm may smooth the acoustic signal to improve the identification of trends, patterns, and other elements from the acoustic signal. The signal smoother 340 may smooth the acoustic signal in any manner. For example, the signal smoother 340 may smooth the date using a global algorithm, a local algorithm, a moving average algorithm, and combinations thereof. In some examples, the signal smoother 340 may use an enveloping algorithm, additive smoothing, a Butterworth filter, a Chebyshev filter, a digital filter, exponential smoothing, a Kalman filter, a kernal smoother, a low-pass filter, any other smoothing algorithm, and combinations thereof.

The acoustic signal processor 334 may further include a background signal subtractor 342. The background signal subtractor 342 may subtract background signals from the acoustic signal (or the portion of the acoustic signal isolated or selected by the signal selection manager 336). For example, the background signal subtractor 342 may receive a pre-determined background signal based on the material of the wellhead, the shape of the wellhead (including protrusions and hollows), and so forth. In some examples, the background signal subtractor 342 may identify the background noise. For example, the background signal subtractor 342 may identify background noise based on historical signals or previously measured acoustic signal (including test pulses emitted by the acoustic pulse emitter 330 for the express purpose of identifying background noise) resulting from an acoustic pulse when it is known that the downhole equipment is not landed at the wellhead. In some examples, the background signal subtractor 342 may identify background noise based on an average signal of historical or test acoustic signals, including an average of 2, 3, 4, 5, 6, 7, 8, 9, 10, or more historical acoustic signals. In some embodiments, the background signal subtractor 342 may continuously identify a rolling average of historical acoustic signals based on recently received acoustic signals. In some embodiments, the background signal subtractor 342 may identify background noise based on reflections received before the acoustic wave returns from the landing location.

A reflection magnitude analyzer 344 may receive the processed acoustic signal and identify patterns, frequency, magnitudes, amplitudes, or other elements of the acoustic signal that may be associated with a particular structure or configuration. In some embodiments, the reflection magnitude analyzer 344 may identify patterns using a standard deviation, variance, CE means square, Euclidean distance, cosine distance, and so forth. In some embodiments, the reflection magnitude analyzer 344 may identify the reflection characterization by identify a root mean square of the acoustic signal, or the isolated portion of the acoustic signal.

A contact identification engine 346 may analyze the reflection characterization identified by the reflection magnitude analyzer 344 and determine whether the reflection characterization is associated with the landing configuration. For example, the contact identification engine 346 may compare the reflection characterization to a predetermined threshold based on the landing configuration. The predetermined threshold may be developed by emitting an acoustic pulse when the downhole equipment is known to be in the landing configuration. The contact identification engine 346 may generate the template based on the received acoustic signal when the downhole equipment is in the landing configuration.

In some embodiments, the wellhead landing detection system 300 may identify whether the downhole equipment is in the landing configuration in real time, or while an operator is attempting to land the downhole equipment at the wellhead. The operator may utilize the output from the contact identification engine 346 to identify whether the downhole equipment is landed. This may help to increase the accuracy of identifying the landing configuration at the wellhead. In some embodiments, the wellhead landing detection system 300 may reduce the amount of time the operator may spend ensuring that the downhole equipment has landed at the wellhead, thereby reducing the installation time of the downhole equipment.

Figure 4:
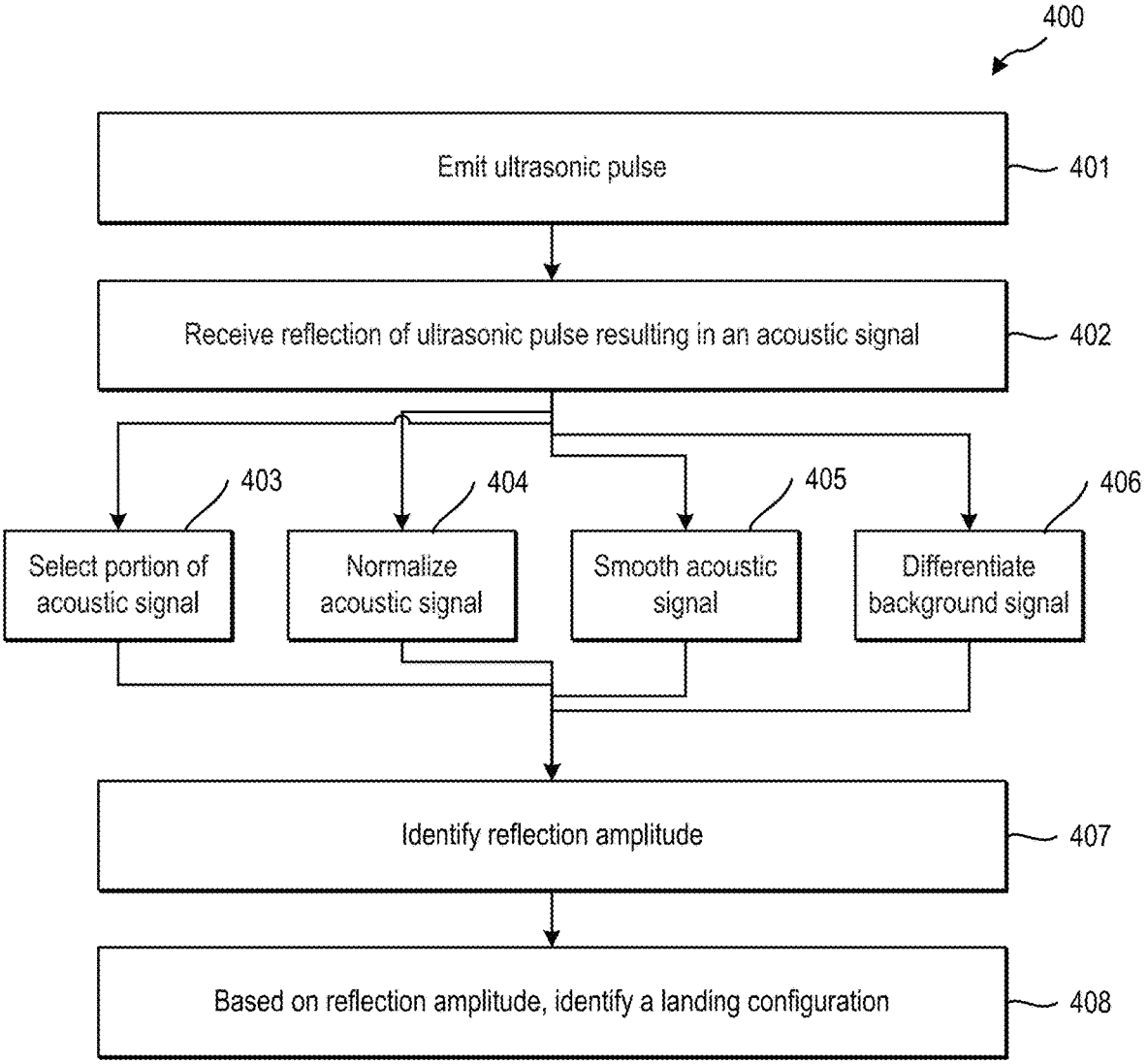
FIG. 4 is a flowchart of a method for identifying a landing, locking, and sealing configuration, according to at least one embodiment of the present disclosure.
Figure 5:
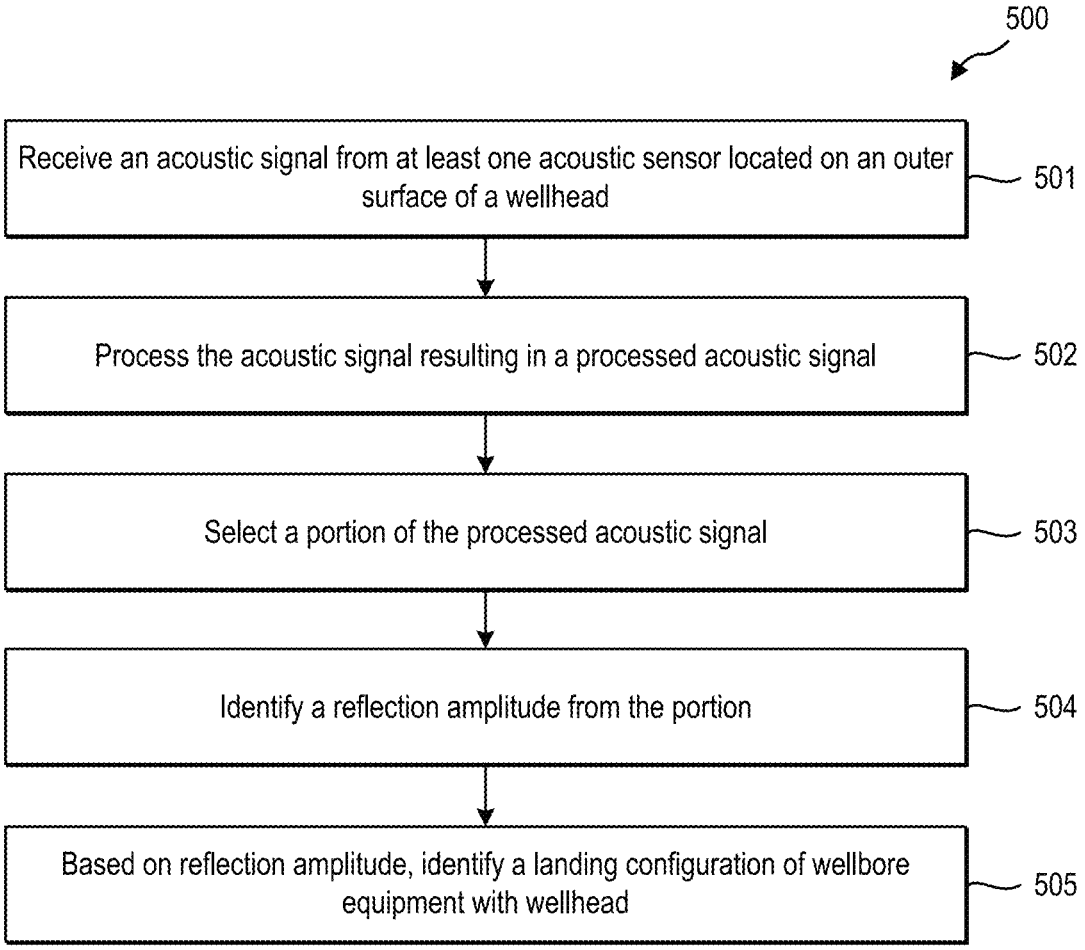
FIG. 5 is a flowchart of a method for identifying a landing, locking, and sealing configuration, according to at least one embodiment of the present disclosure.
Figure 6:
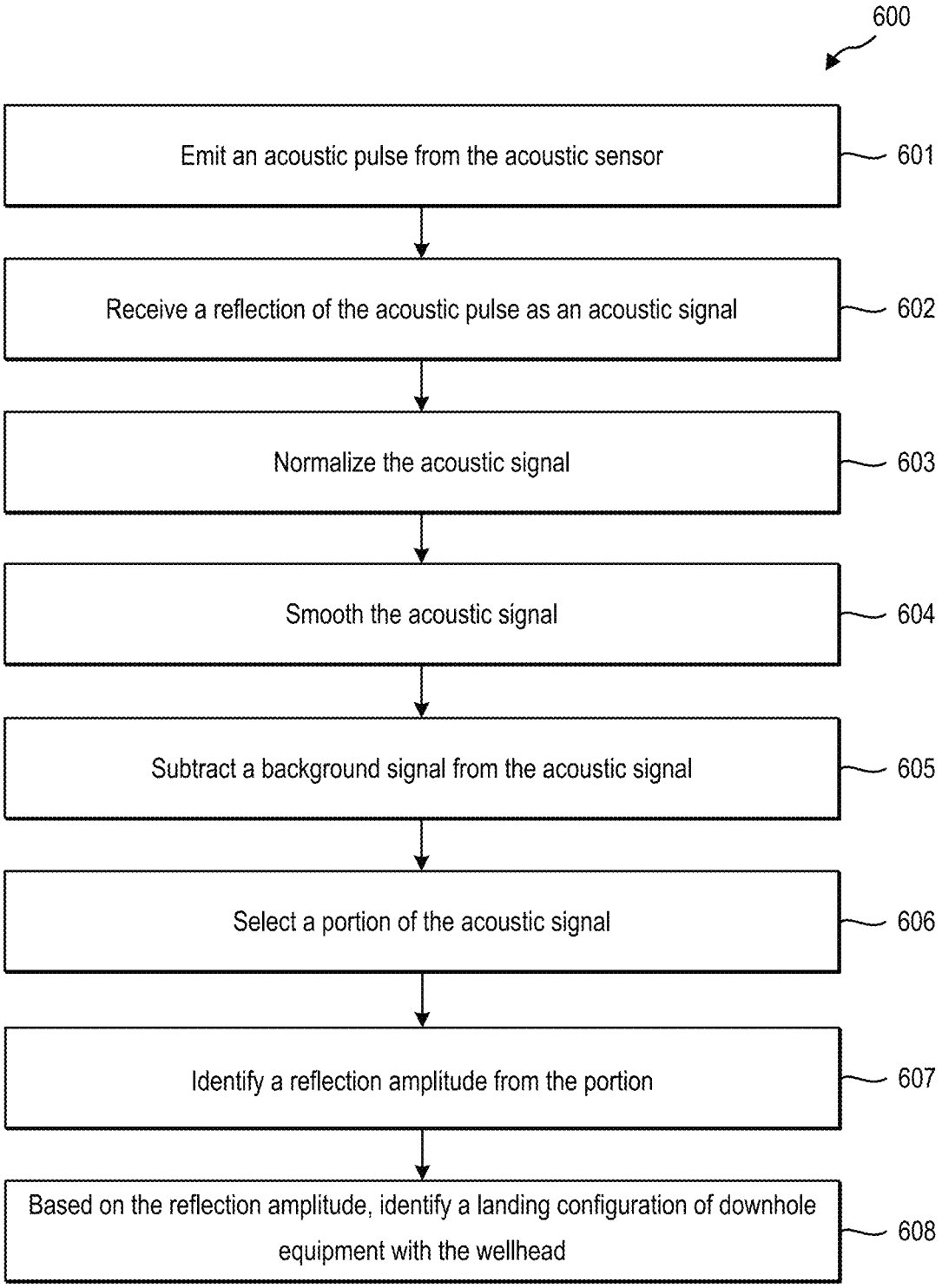
FIG. 6 is a flowchart of a method for identifying a landing, locking, and sealing configuration, according to at least one embodiment of the present disclosure.

FIG. 4-6, the corresponding text, and the examples provide a number of different methods, systems, devices, and computer-readable media of the wellhead landing detection system. In addition to the foregoing, one or more embodiments can also be described in terms of flowcharts comprising acts for accomplishing a particular result, as shown in FIG. 4-6. FIG. 4-6 may be performed with more or fewer acts. Further, the acts may be performed in differing orders. Additionally, the acts described herein may be repeated or performed in parallel with one another or parallel with different instances of the same or similar acts.

As mentioned, FIG. 4 illustrates a flowchart of a series of acts or a method 400 for identifying a landing condition at a wellhead, according to at least one embodiment of the present disclosure. While FIG. 4 illustrates acts according to one embodiment, alternative embodiments may omit, add to, reorder, and/or modify any of the acts shown in FIG. 4. The acts of FIG. 4 can be performed as part of a method. Alternatively, a computer-readable medium can comprise instructions that, when executed by one or more processors, cause a computing device to perform the acts of FIG. 4. In some embodiments, a system can perform the acts of FIG. 4.

A wellhead landing detection system may, from an acoustic sensor, emit an ultrasonic pulse on the outer surface of a wellhead at 401. The resulting acoustic wave may travel or propagate through the wellhead. Portions of the acoustic wave may be reflected or otherwise returned to the acoustic sensor, which may measure the resulting acoustic wave as an acoustic signal at 402. The wellhead landing detection system may receive the acoustic signal.

The wellhead landing detection system may process the acoustic signal. For example, as discussed herein, processing the acoustic signal may include one or more of selecting a portion of the acoustic signal at 403, normalizing the acoustic signal at 404, smoothing the acoustic signal at 405, and subtracting background noise at 406. The acts of selecting, normalizing, smoothing, and subtracting may occur in any order. For example, the wellhead landing detection system may select or isolate the portion of the acoustic signal, resulting in a selected portion or an isolated portion. The wellhead landing detection system may normalize the acoustic signal resulting in a normalized acoustic signal. The wellhead landing detection system may smooth the acoustic signal, resulting in a smoothed acoustic signal. The wellhead landing detection system may subtract the background noise from the acoustic signal, resulting in a subtracted acoustic signal.

In some embodiments, the wellhead landing detection system may select or isolate one or more of the normalized acoustic signal, the smoothed acoustic signal, or the subtracted acoustic signal. In some embodiments, the wellhead landing detection system may normalize one or more of the isolated acoustic signal, the smoothed acoustic signal, or the subtracted acoustic signal. In some embodiments, the wellhead landing detection system may smooth one or more of the normalized acoustic signal, the isolated acoustic signal, or the subtracted acoustic signal. In some embodiments, the wellhead landing detection system may subtract one or more of the normalized acoustic signal, the smoothed acoustic signal, or the isolated acoustic signal. The acts of selecting or isolating, normalizing, smoothing, and subtracting may result in a processed acoustic signal.

The wellhead landing detection system may further identify a reflection characterization of the processed acoustic signal at 407. For example, the wellhead landing detection system may analyze the processed acoustic signal for patterns, peaks, or other elements that may indicate that the downhole equipment is in the landing configuration. In some embodiments, the wellhead landing detection system may identify the landing configuration based on the reflection characterization at 408. For example, the wellhead landing detection system may compare the reflection characterization to predetermined patterns or thresholds to determine whether the downhole equipment is in the landing configuration.

As mentioned, FIG. 5 illustrates a flowchart of a series of acts or a method 500 for identifying a landing condition at a wellhead, according to at least one embodiment of the present disclosure. While FIG. 5 illustrates acts according to one embodiment, alternative embodiments may omit, add to, reorder, and/or modify any of the acts shown in FIG. 5. The acts of FIG. 5 can be performed as part of a method. Alternatively, a computer-readable medium can comprise instructions that, when executed by one or more processors, cause a computing device to perform the acts of FIG. 5. In some embodiments, a system can perform the acts of FIG. 5.

A wellhead landing detection system may receive an acoustic signal from at least one acoustic sensor located on an outer surface of a wellhead at 501. The wellhead landing detection system may process the acoustic signal resulting in a processed acoustic signal at 502. As discussed in further detail herein, processing the acoustic signal may include normalizing, smoothing, and/or subtracting a background signal from the acoustic signal. The wellhead landing detection system may select a portion of the processed acoustic signal at 503. The wellhead landing detection system may identify a reflection characterization from the portion at 504. The wellhead landing detection system may, based on the reflection characterization, identify a landing configuration of well bore equipment with the wellhead at 505.

As mentioned, FIG. 6 illustrates a flowchart of a series of acts or a method 600 for identifying a landing condition at a wellhead, according to at least one embodiment of the present disclosure. While FIG. 6 illustrates acts according to one embodiment, alternative embodiments may omit, add to, reorder, and/or modify any of the acts shown in FIG. 6. The acts of FIG. 6 can be performed as part of a method. Alternatively, a computer-readable medium can comprise instructions that, when executed by one or more processors, cause a computing device to perform the acts of FIG. 6. In some embodiments, a system can perform the acts of FIG. 6.

A wellhead landing detection system may emit an acoustic pulse from an acoustic sensor at 601. The wellhead landing detection system may receive a reflection of the acoustic pulse as an acoustic signal at 602. The wellhead landing detection system may normalize the acoustic signal at 603, smooth the acoustic signal at 604, and subtract a background signal from the acoustic signal at 605. The wellhead landing detection system may select a portion of the acoustic signal at 606. The wellhead landing detection system may identify a reflection characterization from the selected portion at 607. The wellhead landing detection system may, based on the reflection characterization, identify a landing configuration of downhole equipment with the wellhead at 608.

Figure 7:
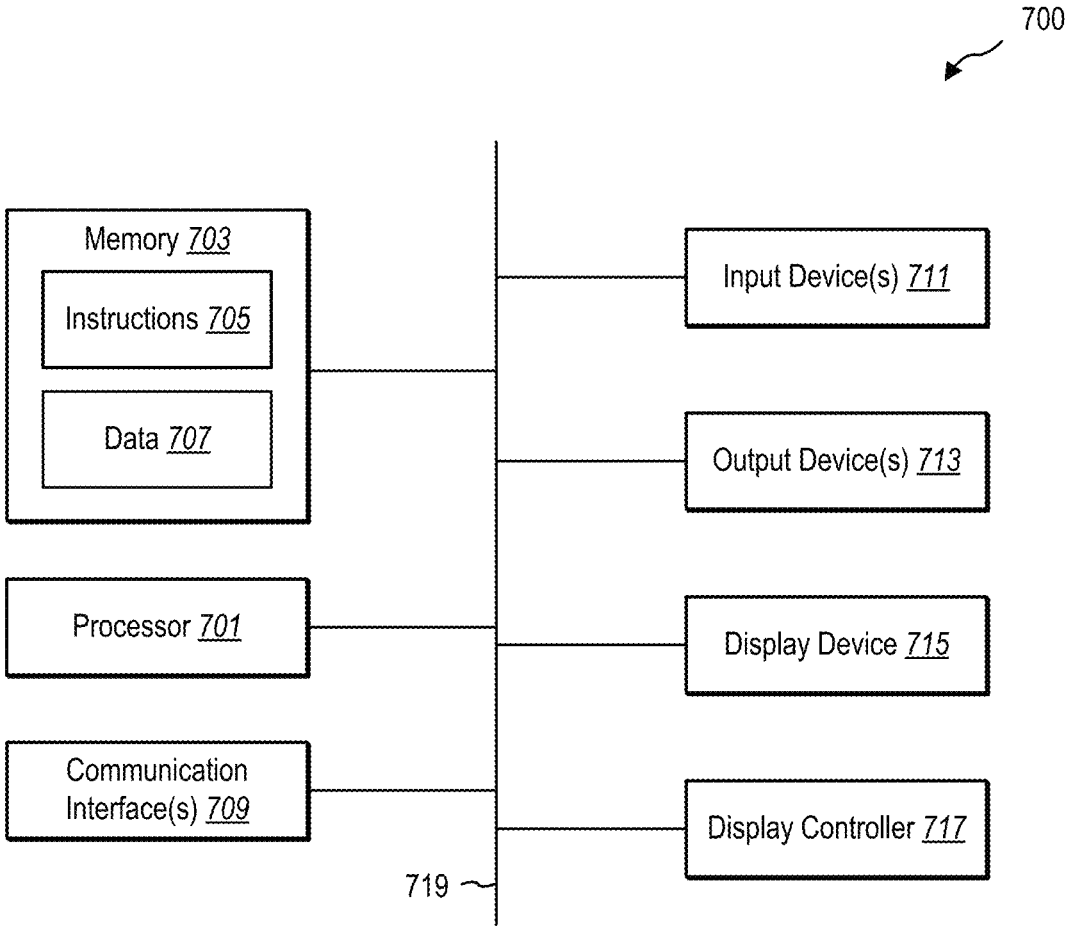
FIG. 7 is a representation of a computing system, according to at least one embodiment of the present disclosure.

FIG. 7 illustrates certain components that may be included within a computer system 700. One or more computer systems 700 may be used to implement the various devices, components, and systems described herein.

The computer system 700 includes a processor 701. The processor 701 may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 701 may be referred to as a central processing unit (CPU). Although just a single processor 701 is shown in the computer system 700 of FIG. 7, in an alternative configuration, a combination of processors (e.g., an ARM and DSP) could be used.

The computer system 700 also includes memory 703 in electronic communication with the processor 701. The memory 703 may be any electronic component capable of storing electronic information. For example, the memory 703 may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions 705 and data 707 may be stored in the memory 703. The instructions 705 may be executable by the processor 701 to implement some or all of the functionality disclosed herein. Executing the instructions 705 may involve the use of the data 707 that is stored in the memory 703. Any of the various examples of modules and components described herein may be implemented, partially or wholly, as instructions 705 stored in memory 703 and executed by the processor 701. Any of the various examples of data described herein may be among the data 707 that is stored in memory 703 and used during execution of the instructions 705 by the processor 701.

A computer system 700 may also include one or more communication interfaces 709 for communicating with other electronic devices. The communication interface(s) 709 may be based on wired communication technology, wireless communication technology, or both. Some examples of communication interfaces 709 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system 700 may also include one or more input devices 711 and one or more output devices 713. Some examples of input devices 711 include a keyboard, mouse, microphone, remote control device, button, joystick, trackball, touchpad, and lightpen. Some examples of output devices 713 include a speaker and a printer. One specific type of output device that is typically included in a computer system 700 is a display device 715. Display devices 715 used with embodiments disclosed herein may utilize any suitable image projection technology, such as liquid crystal display (LCD), light-emitting diode (LED), gas plasma, electroluminescence, or the like. A display controller 717 may also be provided, for converting data 707 stored in the memory 703 into text, graphics, and/or moving images (as appropriate) shown on the display device 715.

The various components of the computer system 700 may be coupled together by one or more buses, which may include a power bus, a control signal bus, a status signal bus, a data bus, etc. For the sake of clarity, the various buses are illustrated in FIG. 7 as a bus system 719.

The embodiments of the wellhead detection system have been primarily described with reference to wellbore drilling operations; the wellhead detection systems described herein may be used in applications other than the drilling of a wellbore. In other embodiments, wellhead detection systems according to the present disclosure may be used outside a wellbore or other downhole environment used for the exploration or production of natural resources. For instance, wellhead detection systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for detecting a landing configuration of equipment, the method comprising:

receiving an acoustic signal from at least one acoustic sensor located on an outer surface of surface equipment near a wellhead;

processing the acoustic signal resulting in a processed acoustic signal, wherein processing the acoustic signal includes:

normalizing the acoustic signal;

smoothing the acoustic signal; and differentiating a background signal from the acoustic signal;

selecting a portion of the processed acoustic signal based on a thickness of the wellhead;

identifying a reflection characterization from the portion; and based on the reflection characterization, identifying a landing configuration of the equipment with the wellhead.

2. The method of claim 1, wherein identifying the reflection characterization includes identifying an average or root mean square of the portion.

3. The method of claim 1, wherein identifying the landing configuration of the equipment with the wellhead includes comparing the reflection characterization to a predetermined threshold.

4. The method of claim 1, wherein normalizing the acoustic signal includes subtracting a maximum value of the acoustic signal from the acoustic signal.

5. The method of claim 1, wherein differentiating the background signal includes subtracting a pre-determined background signal.

6. The method of claim 1, wherein differentiating the background signal includes subtracting an average of historical signals.

7. The method of claim 6, wherein the historical signals include signals prior to contact of the equipment with the wellhead.

8. The method of claim 1, wherein smoothing the acoustic signal includes enveloping the acoustic signal.

9. The method of claim 1, wherein normalizing the acoustic signal results in a normalized acoustic signal, and wherein smoothing the acoustic signal includes smoothing the normalized acoustic signal resulting in a smoothed acoustic signal, and wherein differentiating the background signal includes subtracting the background signal from the smoothed acoustic signal.

10. A wellhead landing detection system, comprising:

one or more acoustic sensors configured to be secured to an outer surface of a wellhead opposite or adjacent to a landing location at an inner surface of the wellhead; and a processor and memory, the memory including instructions that cause the processor to:

emit an acoustic pulse from the one or more acoustic sensors;

receive a reflection of the acoustic pulse as an acoustic signal;

process the acoustic signal resulting in a processed acoustic signal, wherein processing the acoustic signal includes:

normalizing the acoustic signal;

smoothing the acoustic signal; and differentiating a background signal from the acoustic signal;

select a portion of the processed acoustic signal based on a thickness of the wellhead;

identify a reflection characterization from the portion; and based on the reflection characterization, identify a landing configuration of equipment with the wellhead.

11. The wellhead landing detection system of claim 10, wherein the one or more acoustic sensors include a plurality of acoustic sensors positioned around the outer surface of the wellhead and the acoustic pulse includes a plurality of acoustic pulses, and wherein each of the plurality of acoustic sensors emit one of the plurality of acoustic pulses.

12. The wellhead landing detection system of claim 11, wherein identifying the reflection characterization includes identifying a first reflection characterization based on a first acoustic sensor of the plurality of acoustic sensors and identifying a second reflection characterization based on a second acoustic sensor of the plurality of acoustic sensors, and wherein identifying the landing configuration of the equipment with the wellhead includes identifying the landing configuration based on the first reflection characterization and the second reflection characterization.

13. The wellhead landing detection system of claim 12, wherein the first acoustic sensor is located opposite the second acoustic sensor on the wellhead.

14. The wellhead landing detection system of claim 10, wherein differentiating the background signal includes identifying an average signal based on historical acoustic signals.

15. The wellhead landing detection system of claim 10, wherein the acoustic pulse is one of a plurality of acoustic pulses, and wherein emitting the acoustic pulse includes periodically emitting the plurality of acoustic pulses.

16. The wellhead landing detection system of claim 15, wherein the instructions further cause the processor to identify the background signal based on some of the plurality of acoustic pulses.

17. The wellhead landing detection system of claim 10, wherein the wellhead includes a production wellhead.

18. A method for identifying a landing configuration, the method comprising:

emitting an acoustic pulse from an acoustic sensor located on an outer surface of a wellhead;

receiving a reflection of the acoustic pulse as an acoustic signal;

normalizing the acoustic signal;

smoothing the acoustic signal;

differentiating a background signal from the acoustic signal;

selecting a portion of the acoustic signal based on a thickness of the wellhead;

identifying a reflection characterization from the portion; and based on the reflection characterization, identifying a landing configuration of equipment with the wellhead.

* * * * *